US009968231B2

(12) United States Patent
Bassett et al.

(10) Patent No.: US 9,968,231 B2
(45) Date of Patent: May 15, 2018

(54) FLOOR CLEANING HEAD

(71) Applicant: Conta s.r.o., Podborany (CZ)

(72) Inventors: Alexander Anthony Denny Bassett, Suzhou (CN); Chengling Zhang, Suzhou (CN)

(73) Assignee: Conta, S.R.O. (CZ)

( * ) Notice: Subject to any disclaimer, the term of this patent is extended or adjusted under 35 U.S.C. 154(b) by 441 days.

(21) Appl. No.: 14/879,048

(22) Filed: Oct. 8, 2015

(65) Prior Publication Data

US 2016/0100734 A1 Apr. 14, 2016

(30) Foreign Application Priority Data

Oct. 9, 2014 (CN) ..... 2014 1 0528118

(51) Int. Cl.
*A47L 9/06* (2006.01)
*A47L 9/02* (2006.01)
(Continued)

(52) U.S. Cl.
CPC ..... *A47L 9/0666* (2013.01); *A47L 7/0004* (2013.01); *A47L 7/0009* (2013.01); *A47L 7/0014* (2013.01);
(Continued)

(58) Field of Classification Search
CPC .... A47L 9/0666; A47L 9/066; A47L 11/4044; A47L 9/06; A47L 9/0653; A47L 9/0626; A47L 7/0004
(Continued)

(56) References Cited

U.S. PATENT DOCUMENTS 1,038,383 A * 9/1912 Jones ..... A47L 9/02 15/369
1,451,553 A * 4/1923 Reed ..... A47L 9/02 15/369
(Continued)

FOREIGN PATENT DOCUMENTS

CN 201410528118.1 5/2016
EP 1875846 A2 1/2008
(Continued)

OTHER PUBLICATIONS

U.K. Intellectual Property Office, GB Application No. G.B. 1503347.5, "Search Report under Section 17" dated Jul. 20, 2015, 3 pages.
(Continued)

*Primary Examiner* — Bryan R Muller
(74) *Attorney, Agent, or Firm* — Kang S. Lim

(57) ABSTRACT

A floor cleaning head 10 comprises a body portion 12 and a pivotally attached nozzle 16. The nozzle 16 comprises resiliently flexible front and rear extending elongate blades 33, 34 depending from the underside thereof and a transversely extending suction mouth 20 disposed between the blades 33, 34, and intersected by a steam inlet duct 37 to form frontal and rear portions 20F, 20R. The orientation of the nozzle 16 is altered by a mechanism 23, such that the leading blade 33, 34 raises to allow dust and debris to pass beneath, while the trailing blade 34, 33 lowers to form a working edge against the floor surface, against which, dust, dirty water and debris gathers for removal by the induced airflow of an attached floor cleaner (not shown). The head 10 is thus configured to perform separate vacuuming and steam cleaning operations simultaneously, in a single pass.

17 Claims, 4 Drawing Sheets

(51) Int. Cl.
*A47L 7/00* (2006.01)
*A47L 11/40* (2006.01)
*A47L 11/34* (2006.01)

(52) U.S. Cl.
CPC ..... *A47L 9/06* (2013.01); *A47L 9/066* (2013.01); *A47L 9/068* (2013.01); *A47L 9/0653* (2013.01); *A47L 11/34* (2013.01); *A47L 11/4044* (2013.01); *A47L 9/0606* (2013.01); *A47L 11/4072* (2013.01); *A47L 11/4086* (2013.01)

(58) Field of Classification Search
USPC ..... 15/369
See application file for complete search history.

(56) References Cited

U.S. PATENT DOCUMENTS 2,553,034 A * 5/1951 Bridge ..... A47L 11/30 15/331
3,002,217 A 10/1961 Smithson et al.
3,992,747 A * 11/1976 Hufton ..... A47L 11/30 15/321
7,013,521 B2 * 3/2006 Grey ..... A46B 13/001 15/377
8,365,351 B2 * 2/2013 Windmeisser ..... A47L 11/29 15/361

FOREIGN PATENT DOCUMENTS

EP 2329755 A2 6/2011
GB 2471918 A 1/2011
JP H04261630 A 9/1992
WO WO 2013/027140 A1 2/2013

OTHER PUBLICATIONS

European Patent Office, EPO Application No. 15189159.5-1712, "European Search Report", dated Apr. 16, 2012, 6 pages.

* cited by examiner

FLOOR CLEANING HEAD

CROSS REFERENCE TO RELATED APPLICATION

This application claims the benefit of Chinese Patent Application No. 201410528118.1 filed Oct. 9, 2014, which application is incorporated herein in its entirety by this reference.

BACKGROUND

This invention relates to a floor cleaning head which uses steam.

Conventional floor cleaners generally comprise a head which engages with the ground surface and through which dust, dirty water and other debris is collected. The head generally contains a device for guiding dust, such as a brush or bladed structure, towards an inlet duct within the head, so that said dust can be drawn into the cleaner by induced airflow. The body of the cleaner contains means for separating and collecting the dirt and dust that is drawn into the cleaner by a motor and fan unit and disposed in the body. In a so-called canister cleaner, the head is pivoted at the end of a tubular wand which is connected to the body of the cleaner by an elongate flexible duct. Sometimes the head may be detachable, so that the user can fit other kinds of cleaning tools to the wand.

Floor surfaces which are regularly used can often be difficult to clean thoroughly, due to the build up of dust, dirt and other debris attracted through regular use. Steam cleaners are a known way of removing such engrained dirt and dust.

A first type of known steam cleaner simply comprises a steam outlet directed at the floor surface. Disadvantages of this cleaner are that it leaves the floor surface wet, it does not remove dirt and dust, and leaves smears and stains on the floor.

A second type of known steam cleaner comprises a steam outlet directed at the floor surface and a pad or so-called mop which is intended to clean and dry the floor after the steam has been deposited. Disadvantages of this cleaner are that it does not remove dirt and dust, the mop requires frequent cleaning or replacement due to its limited absorptive capacity, and the mop leaves smears and stains on the floor.

A third type of known steam cleaner is similar to the second type but further comprises vacuum cleaner. In use, the floor is firstly cleaned with the vacuum cleaner to pick up dry dirt and dust. The vacuum is then halted and a separate steam cleaning operation is then performed in a similar manner to the second type of known steam cleaner. While this type of cleaner is able to remove dirt and dust, the mop still requires frequent cleaning or replacement due to its limited absorptive capacity, and the mop leaves smears and stains on the floor.

A fourth type of known steam cleaner is able to simultaneously steam and vacuum the floor but it leaves floors damp and is very cumbersome and strenuous to use.

We have now devised an improved floor cleaning head which aims to provide enhanced cleaning of floor surfaces which allows the removal of both dust and larger debris, as well as minimizing streaks, stains and any residual water left on or within the ground surface.

SUMMARY

In accordance with the present invention there is provided a floor cleaning head comprising a body portion and a nozzle portion pivotally attached to the body portion, the nozzle portion comprising:

front and rear transversely extending elongate blades formed of a resiliently flexible material depending from the underside thereof; and a transversely extending suction mouth disposed on the underside thereof between said blades;

the head further comprising means for pivoting the nozzle portion in a first direction such that the suction mouth faces forwardly and the front blade is raised away from a floor surface when the head is moved forwardly across the surface and for pivoting the nozzle portion in a second direction such that the suction mouth faces rearwardly and the rear blade is raised away from the floor surface when the head is moved rearwardly across the surface.

In use, when the head is moved forwardly the nozzle pivots, such that the rear blade is biased against the floor surface and against which dust and dirty water may be collected as well as raising the front blade to allow dirt and dust to pass unhindered under the suction mouth where it is removed by the induced suction. Steam may be applied to the floor surface through a steam outlet, thereby assisting with the removal of engrained dirt from the floor surface. The rear blade is biased against the floor surface and collects the condensed dirty water formed by the application of the steam as well as any dust particles which were not initially picked up by the suction mouth.

When the head is moved rearwardly the nozzle pivots, such that the front blade becomes biased against the floor surface and such that the rear blade is raised. In this manner, the head operates in reverse to its forward operation.

The present invention thus provides a floor cleaning head that leaves the floor surface perfectly dry in a single pass. The head also leaves the floor surface clean in a single pass without having to perform a separate vacuuming operation.

Preferably, the nozzle portion of the head contains a transversely extending elongate steam outlet disposed on the underside thereof between said blades.

Preferably, the steam outlet divides the suction mouth into front and rear transversely extending portions.

Preferably the nozzle is pivoted about an axis which extends transverse the head at the front thereof, a pair of ground-engaging support wheels preferably being mounted for rotation about said axis at respective opposite ends of the nozzle.

The nozzle may be pivoted in the first and second directions by frictional engagement of a portion of the head with the floor surface. However, it is preferred that the nozzle is pivoted by an actuator mechanism arranged to pivot the nozzle according to the direction of movement. The actuator mechanism may be purely mechanical or it may comprise an electrical actuator such as a motor, a solenoid or electromagnet.

Preferably the mechanism comprises a sensor for sensing the direction of movement of the head. Preferably the sensor outputs an electrical signal to said electrical actuator according to the direction of movement of the head.

Preferably the head comprises a ground engaging wheel, said sensor being arranged to sense the direction of rotation the wheel. Preferably the sensor comprises a clutch which is rotated by the wheel to move a cam between a first and second position according to the direction of rotation of the wheel, said cam acting to open and close a switch according to the direction of rotation of the wheel.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

An embodiment of the present invention will now be described by way of an example only and with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

Figure 1:
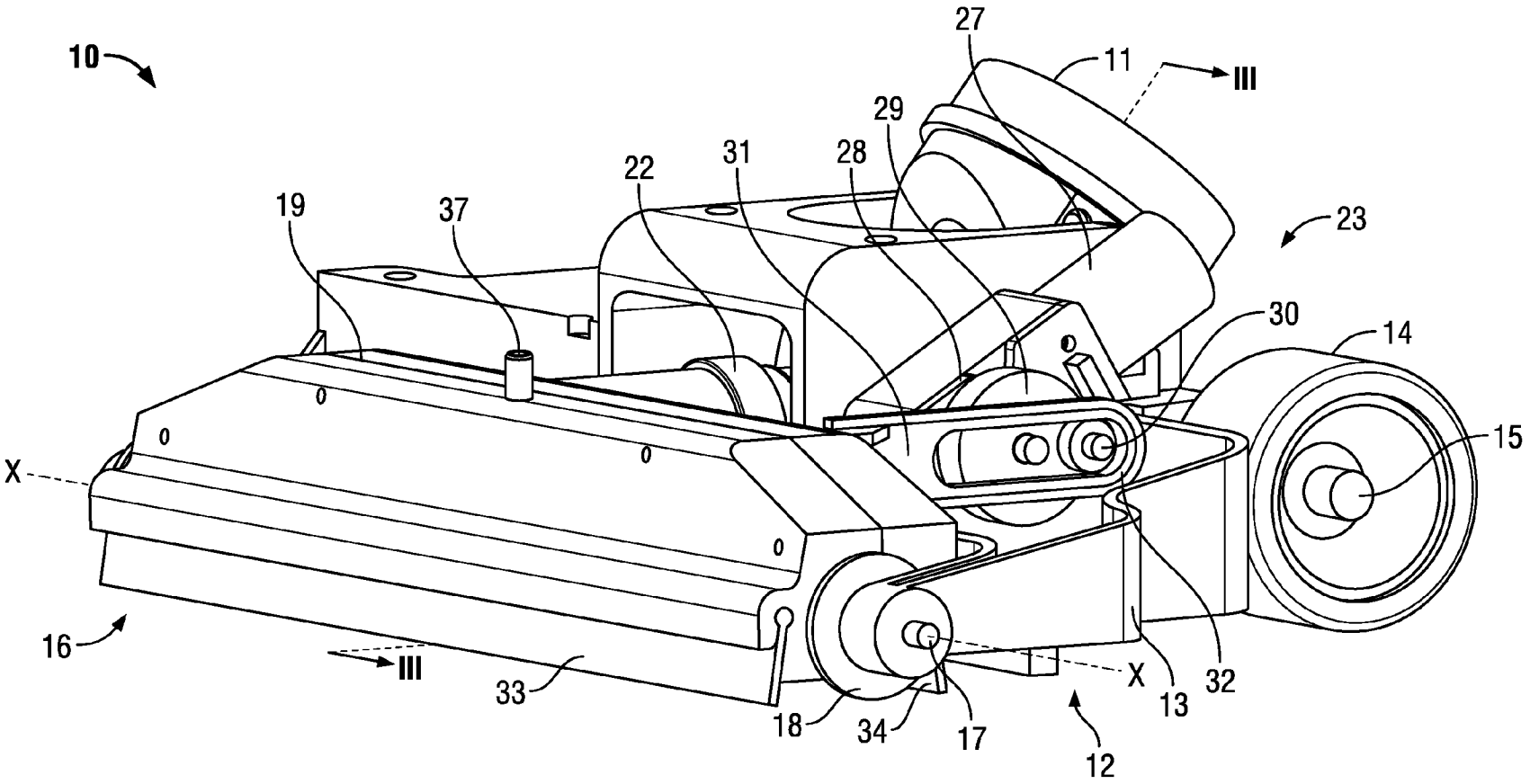
FIG. 1 is a front side view of a floor cleaning head in accordance with the present invention.
Figure 2:
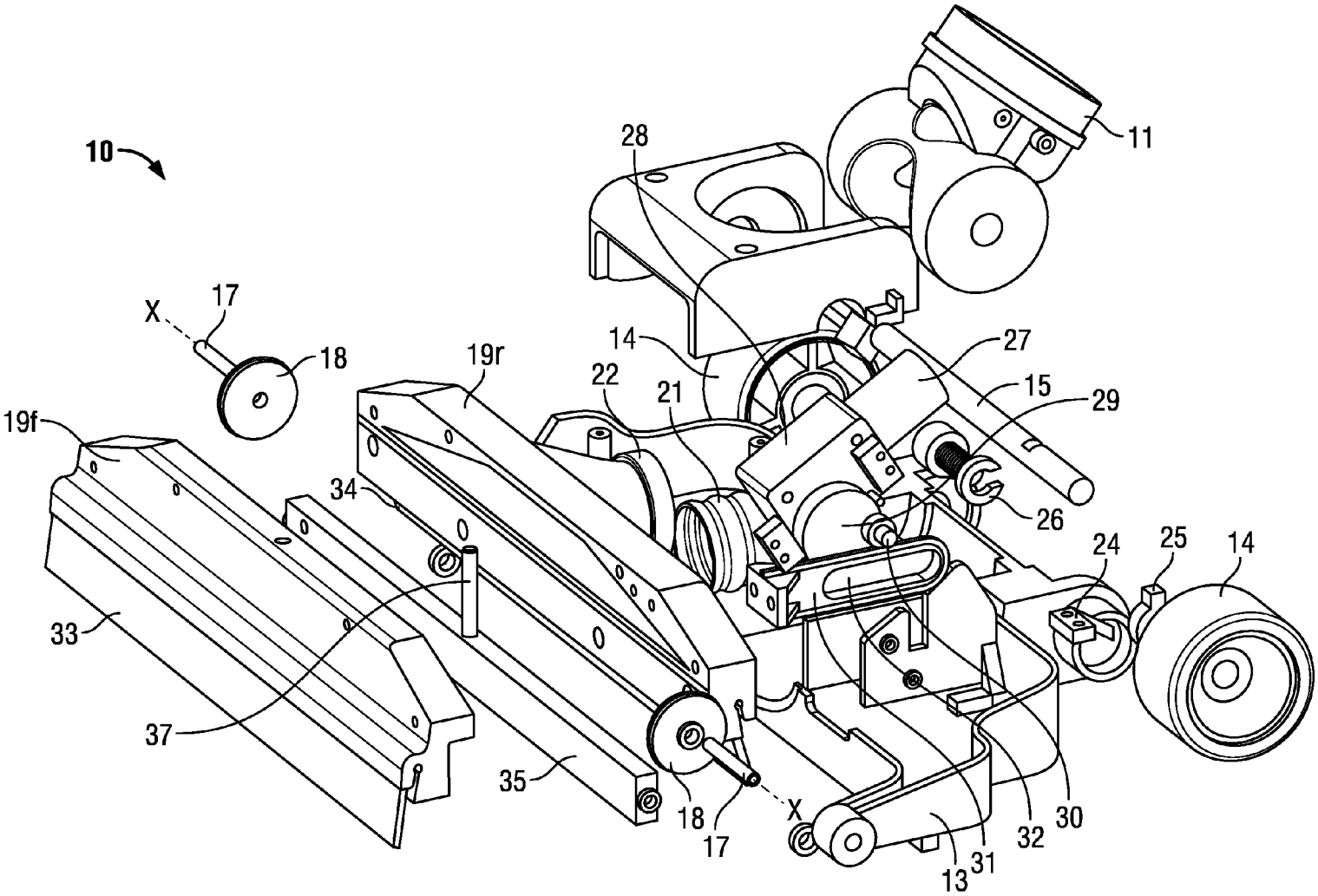
FIG. 2 is an exploded view of the floor cleaning head of FIG. 1.

Referring to FIGS. 1 and 2 of the drawings, there is shown a floor cleaning head 10 in accordance with the present invention for fitting to a steam vacuum cleaner, the rear of the head 10 comprising an outlet duct 11 for coupling to the suction inlet of the vacuum cleaner (not shown), the outlet duct 11 being pivotally mounted to a body portion 12 of the head 10. In use, a motor and fan unit in the body of the vacuum cleaner draws a mixture of air, steam, debris and water through the head 10.

The body portion 12 comprises a chassis 13 having a pair of wheels 14 mounted at the rear thereof on an axle 15. An elongate transversely extending nozzle 16 which is pivotally mounted to the front of chassis 13 for rotation about a transverse axis X-X parallel to the floor surface. The nozzle 16 is pivotally supported at its ends on axles 17 on which ground-engaging wheels 18 are also provided.

The nozzle 16 comprises a hollow housing 19 having a front portion 19F and a rear portion 19R which define a downwardly-facing elongate suction mouth 20 that extends transversely of the head 10 on the underside thereof. The nozzle 16 is connected to the outlet duct 11 via an elongate flexible duct 21 which extends from a port 22 on the rear portion 19R of the housing 19.

The direction of orientation of the nozzle 16 is altered by a mechanism 23, which causes the orientation of the nozzle 16 to alter depending upon the direction of motion of the head 10. The mechanism 23 is activated by a micro-switch 24, which is actuated by a cam 25 that is driven by a simple clutch 26 disposed on the axle 15, such that the micro-switch 24 is only actuated when the wheels 14 turn in the direction of forward movement of the head 10. The micro-switch 24 is not actuated when wheels 14 turn in the direction of rearward movement of the head 10. The output of the micro switch 24 is connected to a motor 27 that drives a gearbox 28 having an output shaft which is driven clockwise and anticlockwise respectively as the head 10 moves forwardly and rearwardly. A rotary wheel 29 is mounted on the output shaft of the gearbox 28, the wheel 29 comprising a spigot 30 which extends axially outwardly from a point which is radially offset from the rotational axis of the wheel 29. An elongate actuator arm 31 is rigidly fixed to the rear portion 19R of the nozzle housing 19. The spigot 30 engages within an elongate mouth 32 which extends longitudinally of the actuator arm 31.

A pair of elongate resiliently flexible wiper blades 33, 34 depend from the lower edges of the front and rear walls of the nozzle 16 respectively. The blades 33, 34 are respectively disposed forwardly and rearwardly of the suction mouth 20 and extend the entire length thereof to form seals in front of and behind the suction mouth 20. An elongate channel-section steam bar 35 is mounted inside the nozzle housing 19 longitudinally of the suction mouth 20, the bar 35 dividing the suction mouth 20 into front and rear portions 20F, 20R. The channel 36 of the bar 35 faces downwardly and a steam inlet duct 37 extends upwardly from the centre of the bar 35, the lower end of the inlet duct 37 being connected to the channel. A steam generator (not shown) mounted in the body of the cleaner delivers steam to the inlet duct 37 via a flexible duct (not shown) connected thereto.

Figure 3:
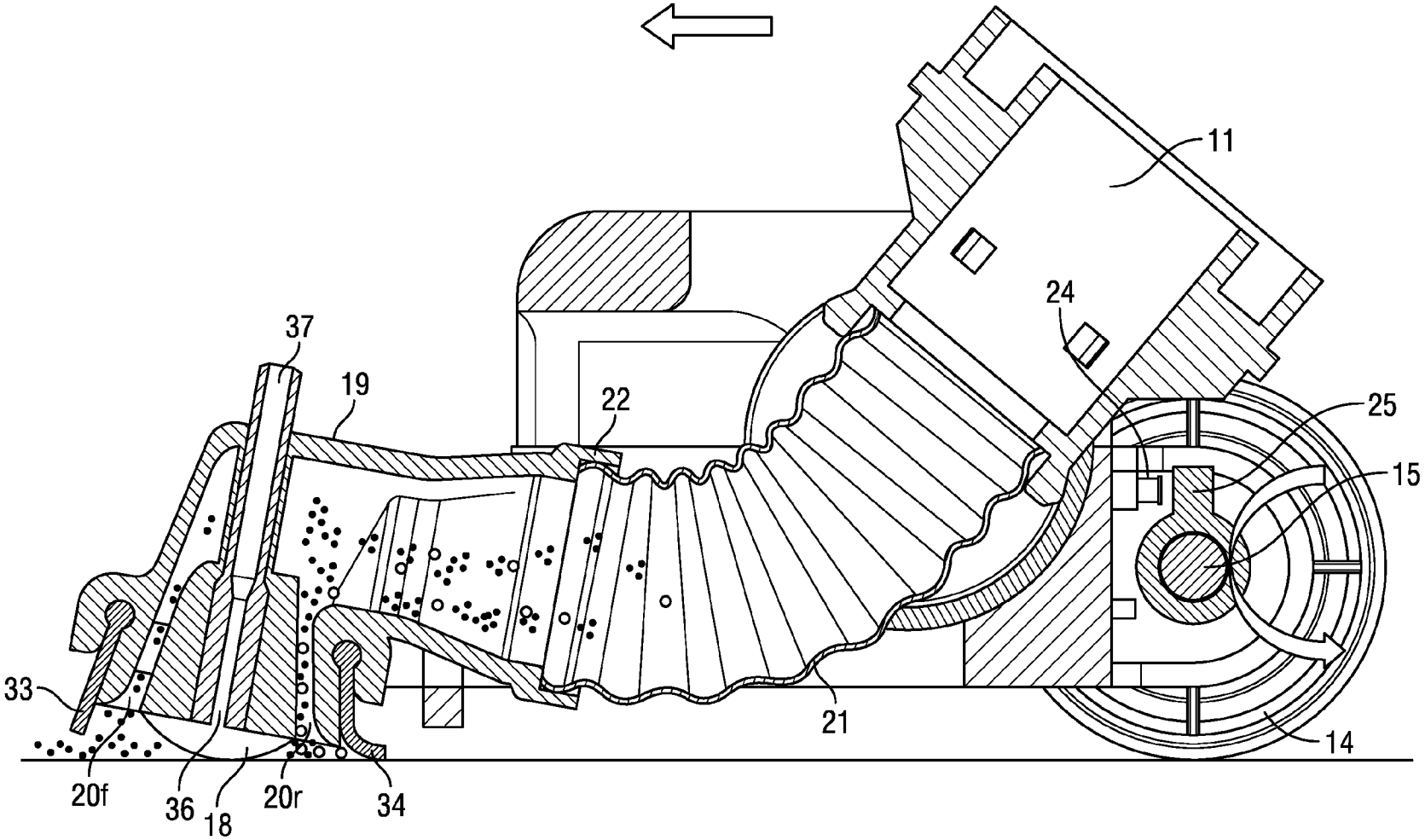
FIG. 3 is a sectional view along the line iii-iii of FIG. 1 when the head is being moved forwardly.

Referring to FIG. 3 of the drawings, in use when the head 10 is moved forwardly, the motor 27 is controllably driven to bring the spigot 30 into its lowermost position: this causes the arm 31 to lower, thereby pivoting the nozzle 16 in a first direction about the axis X-X into a first position, such that the rear blade 34 is compressed slightly against the ground surface and such that the front blade 33 is raised to provide a gap of 2 mm and 8 mm between its lower edge and the floor surface: this allows large dust and debris particles to pass underneath the head 10, where they are drawn into the head 10 through the front portion 20F of the suction mouth 20.

Steam can be selectively applied to the head 10 via the inlet duct 37 where it is directed, through the channel 36, onto the floor surface S by the steam bar 35. The steam acts to clean the floor surface S with some of the steam condensing into water. The rear blade 38 is deformed rearwardly under compression and creates a highly effective seal with the floor surface S across the trailing edge of the head which acts to substantially collect all water and moisturized dust into a position where it is then drawn into the head 10 through the rear portion 20R of the suction mouth 20.

Figure 4:
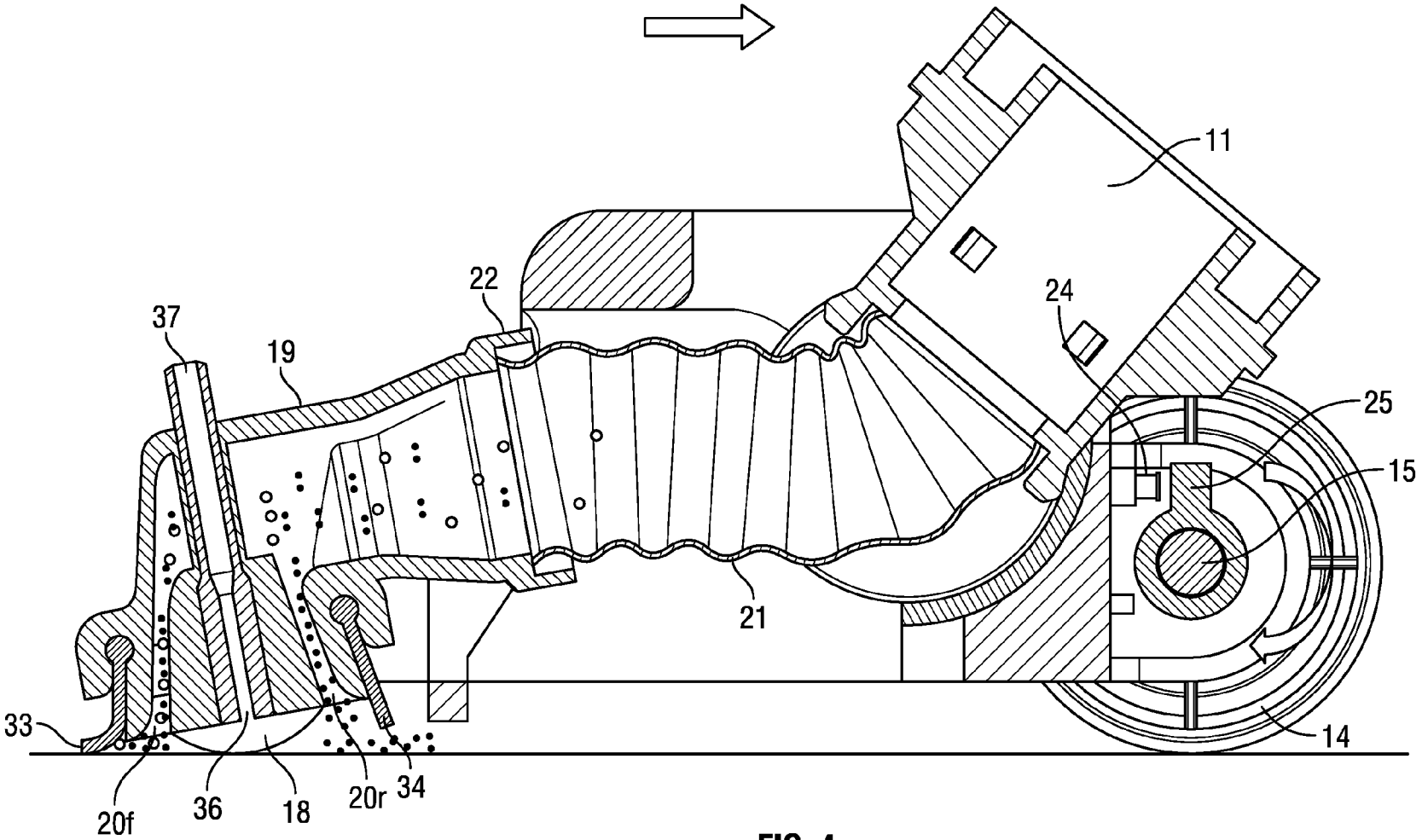
FIG. 4 is a sectional view along the line iii-iii of FIG. 1 when the head is being moved rearwardly.

Referring to FIG. 4 of the drawings, in use when the head 10 is moved rearwardly, the motor 27 is controllably driven to bring the spigot 30 into its uppermost position: this causes the arm 31 to raise, thereby pivoting the nozzle 16 in a second direction about the axis X-X into a second position.

It will be appreciated that as the nozzle 16 pivots from the first to the second positions it passes through a neutral position in which both blades 33, 34 are in contact with the floor surface S. The highly effective sealing provided by the front and rear blades 33, 34 allow a considerable level of suction to be generated under the nozzle 16, such that any accumulated water, moisture or debris remaining between the blades 33, 34 from the previous stroke are quickly drawn into the suction mouth 20 as the rear blade 34 breaks its seal with the floor surface and suction normalizes.

Once the nozzle 16 reaches the second position, the head 10 operates in the same manner as the forward direction but with the roles of the blades 33, 34 and the front and rear portions 20F, 20R being reversed.

A floor cleaning head in accordance with the present invention is simple and inexpensive in construction yet leaves the floor surface S clean and dry in a single pass without having to perform a separate vacuuming and steam cleaning operations.

While the preferred embodiment of the invention has been shown and described, it will be understood by those skilled in the art that changes of modifications may be made thereto without departing from the true spirit and scope of the invention.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A floor cleaning head comprising a body portion and a nozzle portion pivotally attached to the body portion, the nozzle portion comprising:

front and rear transversely extending elongate blades formed of a resiliently flexible material depending from the underside thereof; and a transversely extending suction mouth disposed on the underside thereof between said blades;

the head further comprising a pivot to allow pivoting the nozzle portion in a first direction such that the suction mouth is angled to at least partially face forwardly and the front blade is raised away from a floor surface when the head is moved forwardly across the surface and for pivoting the nozzle portion in a second direction such that the suction mouth is angled to at least partially face rearwardly and the rear blade is raised away from the floor surface when the head is moved rearwardly across the surface.

2. A floor cleaning head, according to claim 1, wherein the nozzle pivots in said first direction when the head moves forwardly, such that the rear blade is biased against the floor surface while the front blade is raised away from the floor surface.

3. A floor cleaning head, as claimed in claim 1, wherein the nozzle pivots in said second direction when the head moves rearwardly, such that the front blade is biased against the floor surface while the rear blade is raised away from the floor surface.

4. A floor cleaning head as claimed in claim 1, wherein the nozzle portion of the head contains a steam outlet disposed on the underside thereof between said blades.

5. A floor cleaning head as claimed in claim 4, wherein the steam outlet is elongate and extends transversely of the head and longitudinally of the suction mouth.

6. A floor cleaning head, as claimed in claim 4, wherein the steam outlet divides the suction mouth into front and rear transversely extending portions.

7. A floor cleaning head, according to claim 1, wherein the nozzle is pivoted about an axis which extends transverse to the front of the head.

8. A floor cleaning head, according to claim 7, wherein a pair of ground-engaging support wheels are mounted about said axis at respective opposite ends of the nozzle.

9. A floor cleaning head, according claim 1, wherein the nozzle is pivoted by an actuator mechanism arranged to pivot the nozzle according to the direction of movement.

10. A floor cleaning head, according to claim 9, wherein the actuator mechanism comprises an electrical actuator.

11. A floor cleaning head, according to claim 9, wherein the actuator mechanism is arranged to sense the direction of movement of the head.

12. A floor cleaning head, according to claim 10, wherein the actuator mechanism comprises a sensor arranged to sense the direction of movement of the head, the sensor being arranged to output an electrical signal to said electrical actuator according to the direction of movement of the head.

13. A floor cleaning head, according to claim 11, wherein the head comprises a ground engaging wheel, the actuator mechanism being arranged to sense the direction of rotation of the wheel.

14. A floor cleaning head, according to claim 13, comprising a cam which is rotated by the wheel between a first and second position according to the direction of rotation of the wheel.

15. A floor cleaning head, according to claim 14, wherein said cam acts to open and close a switch according to the direction of rotation of the wheel.

16. A cleaning apparatus comprising a body and a head as claimed in claim 1, the body comprising a motor and fan unit arranged to draw air into the cleaner through said suction mouth.

17. A cleaning apparatus as claimed in claim 16, wherein the body further comprises a steam generator connected to the head.

* * * * *